US010046566B2

(12) United States Patent
Raoust

(10) Patent No.: US 10,046,566 B2
(45) Date of Patent: Aug. 14, 2018

(54) SYSTEM FOR CLEANING COMPONENTS USED TO CLEAN INKJET PRINTHEADS IN INKJET PRINTERS

(71) Applicant: Xerox Corporation, Norwalk, CT (US)

(72) Inventor: Pascal Raoust, Cadenet (FR)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/228,431

(22) Filed: Aug. 4, 2016

(65) Prior Publication Data

US 2018/0037031 A1 Feb. 8, 2018

Related U.S. Application Data

(60) Provisional application No. 62/369,892, filed on Aug. 2, 2016.

(51) Int. Cl.
*B41J 2/165* (2006.01)

(52) U.S. Cl.
CPC ..... *B41J 2/16535* (2013.01)

(58) Field of Classification Search
None
See application file for complete search history.

(56) References Cited

U.S. PATENT DOCUMENTS 3,706,109 A * 12/1972 Bevier ..... B60S 3/06 15/53.2
4,123,301 A * 10/1978 Pope ..... C21D 1/667 148/508
5,419,347 A * 5/1995 Carruth ..... A61G 7/02 134/113
6,343,850 B1 2/2002 Domagall
6,810,889 B2 * 11/2004 Flaxman ..... B60S 3/04 134/123
6,921,146 B2 7/2005 Wouters
7,210,761 B2 5/2007 Mott et al.
7,815,282 B2 10/2010 Hibbard et al.
8,313,165 B2 11/2012 Hibbard et al.
8,591,001 B2 11/2013 Aude
2003/0063150 A1 * 4/2003 Saito ..... B41J 2/16511 347/30
2016/0031221 A1 * 2/2016 Fernando ..... B41J 2/16547 347/33

* cited by examiner

*Primary Examiner* — Alejandro Valencia
(74) *Attorney, Agent, or Firm* — Maginot Moore & Beck LLP

(57) ABSTRACT

A system in an inkjet printer cleans components in a printhead cleaning system. The system includes a rectangular frame, an actuator configured with a bi-directionally rotating output shaft, a shaft connected to the rotating output shaft, a rinsing member pneumatically connected to a fluid source to enable a fluid from the fluid source to flow to the member and exit through openings in the rinsing member. Cords are connected to the shaft and the member to move the rinsing member from a first position at one end of the frame to a second position at another end of the frame as the output shaft of the actuator rotates in one direction. Fluid is released through the openings in the rinsing member to clean components of a printhead cleaning system as the rinsing member moves. The actuator is reversed to return the rinsing member to the first position.

3 Claims, 6 Drawing Sheets

SYSTEM FOR CLEANING COMPONENTS USED TO CLEAN INKJET PRINTHEADS IN INKJET PRINTERS

CLAIM OF PRIORITY

This application claims priority from provisional patent application having Ser. No. 62/369,892, which is entitled "Improved System For Cleaning Components Used To Clean Inkjet Printheads In Inkjet Printers" and was filed on Aug. 2, 2016.

TECHNICAL FIELD

This disclosure relates generally to inkjet printers, and more particularly, to maintenance systems for cleaning printheads in inkjet printers.

BACKGROUND

Inkjet printers have one or more printheads that eject drops of liquid material, referred to generally as ink, onto a substrate or previously ejected drops of material. Each printhead includes a plurality of inkjets typically arranged in an array. Each inkjet has a nozzle that communicates with an opening in a faceplate of the printhead to enable one or more drops of material to be ejected from the inkjet and through the opening with which the inkjet nozzle communicates in the faceplate. The inkjets can be implemented with a variety of different configurations known to those skilled in the art. Some well-known configurations use piezoelectric and thermal ejectors in the inkjets.

Some of the ink ejected from the inkjets adheres to the faceplate and can collect dust and other debris. If the ink and debris are not removed from the faceplate, then the residual ink and debris may block one or more openings in the faceplate. Printhead cleaning is typically performed within a maintenance station mounted within the printer chassis so the printhead and maintenance station can be moved relative to one another for cleaning. Most maintenance stations include wipers that move across the faceplates of the printheads to remove residual ink and debris that have collected on the faceplates. The wipers are positioned to direct the residual ink and debris into a receptacle for collection. The receptacle is removed and cleaned from time to time.

The wipers and the components that support and maneuver the wipers also collect residual ink and debris. Therefore, the wipers and related components require cleaning as well. Technicians typically perform this cleaning daily and the results can vary from technician to technician. Efficiently cleaning the wipers and related components without operator intervention or further contaminating other components in the printer is beneficial in inkjet printers.

SUMMARY

A cleaning system that enables efficient cleaning of the components used to clean printheads in an inkjet printer includes a pair of parallel members, at least two cross-members that intersect the pair of parallel members to form a frame, an actuator configured with a bi-directionally rotating output shaft, a shaft operatively connected to the rotating output shaft of the actuator to rotate with the output shaft when it rotates, a member having a plurality of openings and the member being pneumatically connected to a fluid source to enable a fluid from the fluid source to flow to the member and egress through the openings, the member being parallel to the at least two cross-members, and at least one cord having a first end and a second end, the first end and the second end being wound around the shaft in opposite directions and the at least one cord being operatively connected to the member to enable the actuator to rotate the shaft and move the member from a first position at one end of the pair of parallel members to a second position at another end of the pair of parallel members as the fluid egresses through the openings in the member and to return the member to the first position.

BRIEF DESCRIPTION OF THE DRAWINGS

The foregoing aspects and other features of a cleaning system that efficiently cleans components used to clean printheads in the printer are explained in the following description, taken in connection with the accompanying drawings.

DETAILED DESCRIPTION

Figure 1:
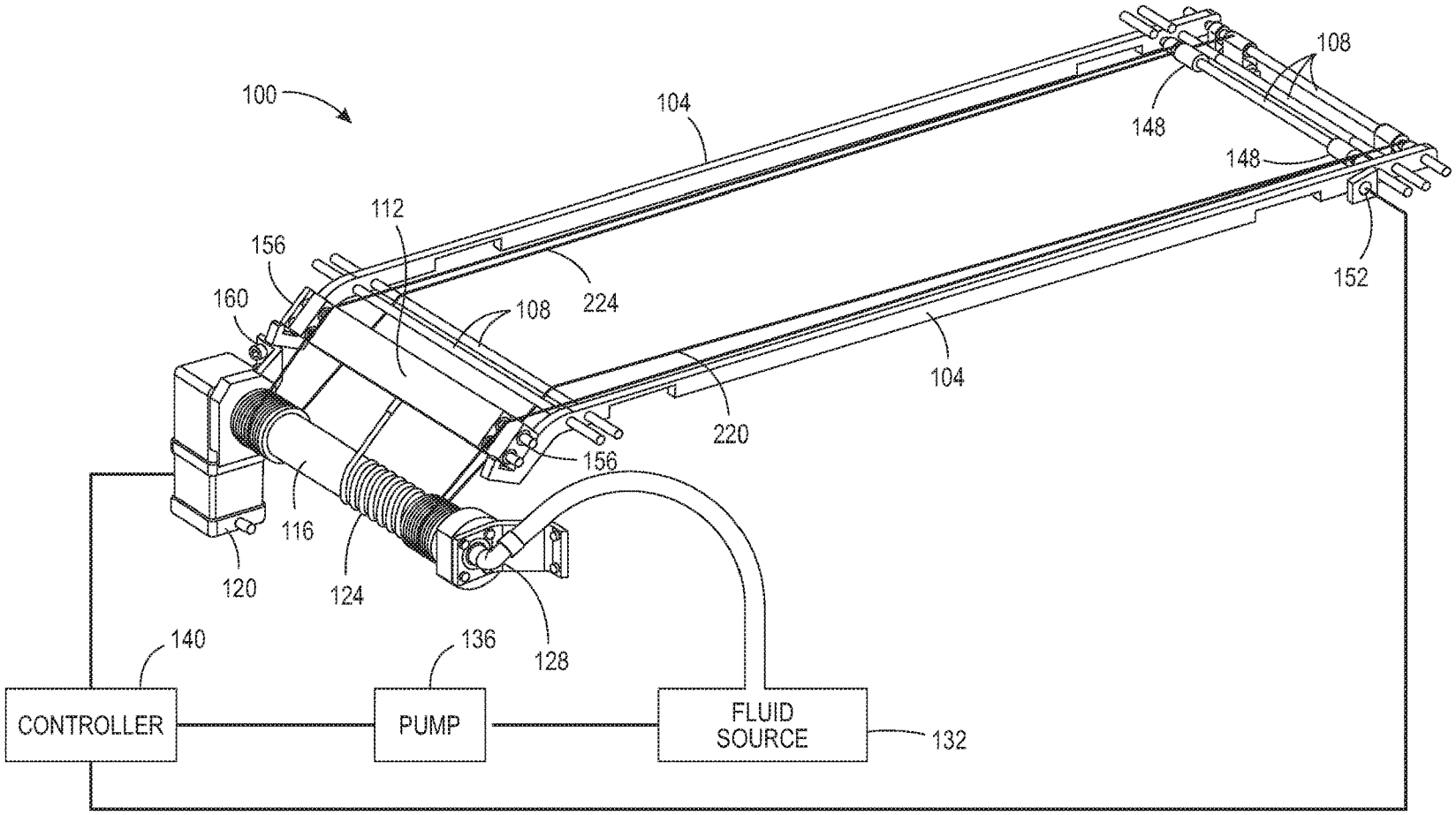
FIG. 1 is a perspective view of a system that cleans components used to clean the faceplate of one or more printheads in an inkjet printer.

For a general understanding of the present embodiments, reference is made to the drawings. In the drawings, like reference numerals have been used throughout to designate like elements.

Figure 2:
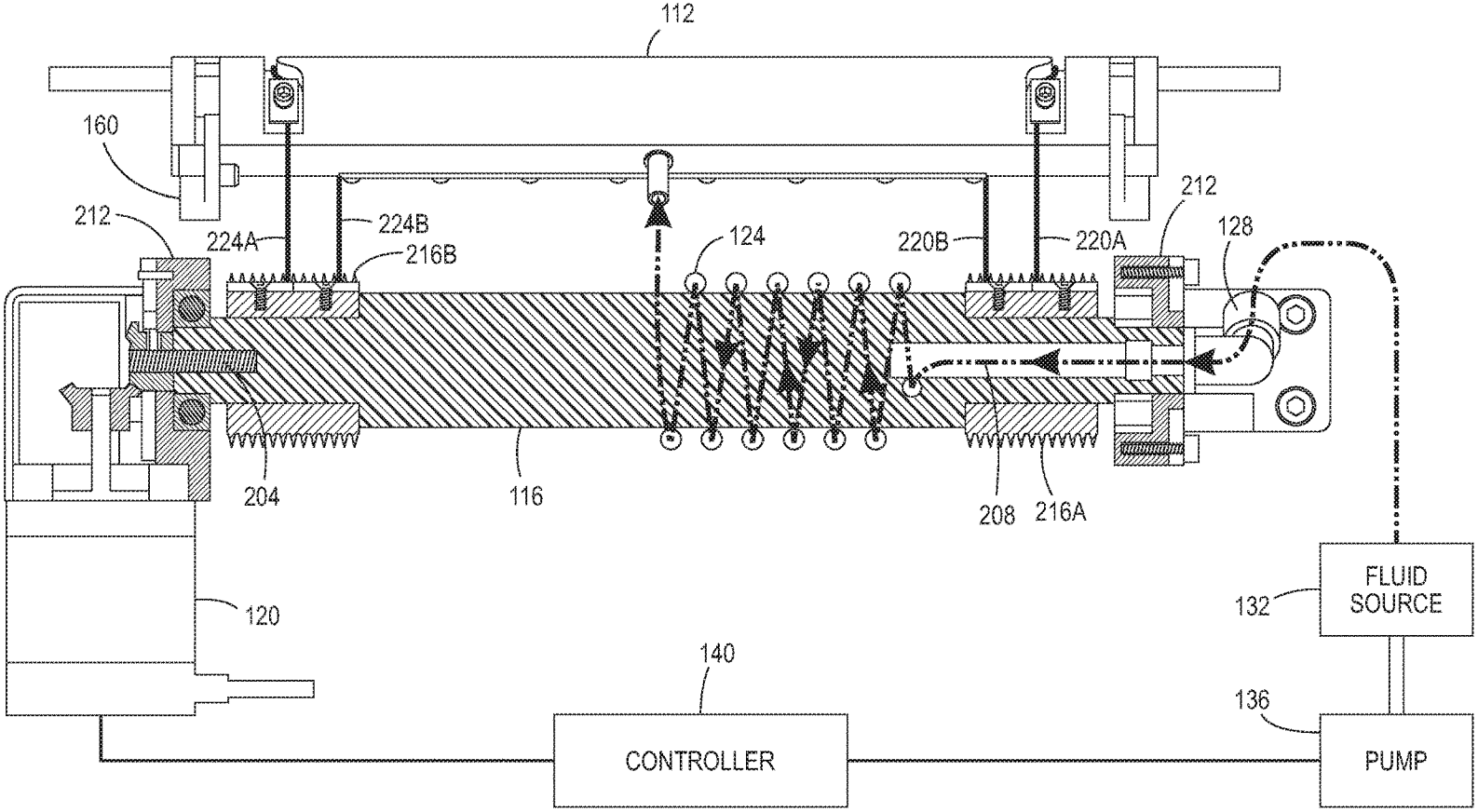
FIG. 2 is a cross-sectional view of a rotating shaft in the system of FIG. 1.

FIG. 1 depicts a system that cleans components used to clean the faceplates of printheads in an inkjet printer. The system 100 includes a pair of guide rails 104, a plurality of cross-members 108, a rinsing member 112, a rotating shaft 116, an actuator 120, a fluid source 132, and a pump 136. The guide rails 104 and the cross-members 108 form a frame along which the rinsing member 112 moves from the position shown in FIG. 1 to the other end of the frame and then back to the position shown in FIG. 1. The rinsing member 112 includes one or more wheels 156 at each end of the rinsing member 112 that roll along the frame as the cords 220 and 224 are wound onto and off the shaft 116. The actuator 120 has a rotating output shaft that is mechanically coupled to through transmission element 204 (FIG. 2) that is operatively connected to the rotating shaft 116 to spin the shaft 116 around its longitudinal axis. Alternatively, the output shaft of actuator 120 can be directly connected to the shaft 116. Other types of actuators can be used to drive the shaft 116, such as a direct drive, an actuator coupled through a transmission, or an actuator driving a pulley and an endless belt or chain. As shown in FIG. 2, the shaft 116 is mounted within bearings 212 to enable the actuator 120 to rotate the shaft 116. The shaft 116 also includes a passageway 208 (FIG. 2) that is connected at one end to a rotating coupling 128 and at another end to flexible tube 124. Flexible tube 124 is wrapped around shaft 116 and one end of the tube 124 is connected to rinsing member 112 to enable fluid to flow from fluid source 132 to the rinsing member 112 when the controller 140 operates pump 136 to pump fluid from the fluid source 132. The rotating coupling 128 connects to the fluid source 132 to enable fluid to flow from the fluid source 132, through the coupling 128 and into the passageway 208. The ability of the coupling 128 to rotate as the shaft 116 rotates helps prevent the hose connecting the coupling to the pump from kinking. Also, as shown in FIG. 1, each cord 220 and 224 has first and second ends that are connected to the rotating shaft 116. A portion of each cord also passes through a tensioning mechanism 148 and the cross-members 108 that are more distal from the shaft 116 than the cross-members 108 proximate the rinsing member 112 at the first position. A sensor 152 generates a signal that indicates the presence and absence of the rinsing member 112 at the distal end of the frame formed by guide rails 104 and the cross-members 108. A similar sensor 160 is positioned at the end of the frame that is closest to the actuator 120 and it is configured to generate a signal that indicates the presence and absence of the rinsing member 112 at the near end of the frame formed by guide rails 104 and the cross-members 108. The controller receives the signals generated by these sensors and uses them to operate the components in the cleaning system 100 as described below.

With further reference to FIG. 2, ribbed nuts 216A and 216B are mounted at each end of the shaft 116. The threaded portion of the nuts 216A and 216B help the cords unwind and wind as the shaft 116 rotates as described below. In the figure, the first end 220A of cord 220 is connected to the ribbed nut 216A and wound around the nut in a clockwise manner, while the second end 220B of cord 220 is connected to the ribbed nut and wound around the nut in a counter-clockwise manner. In the embodiment shown in FIG. 2, the ribbed nut 216B closest to the actuator 120 has a left-hand thread, while the nut 216A, which is further from the actuator, has a right-hand thread. Similarly, the first end 224A of cord 224 is connected to the ribbed nut 216B and wound around the nut in a clockwise manner, while the second end 224B of cord 224 is connected to the ribbed nut and wound around the nut in a counterclockwise manner. The cord 220 is also connected to one end of the rinsing member 112 and the cord 224 is connected to the opposite end of the rinsing member 112. The structure for winding and unwinding the cords at each of the shaft 116 can also be implemented with a pair of pulleys that are fixed to the shaft 116 at each end of the shaft.

Figure 3:
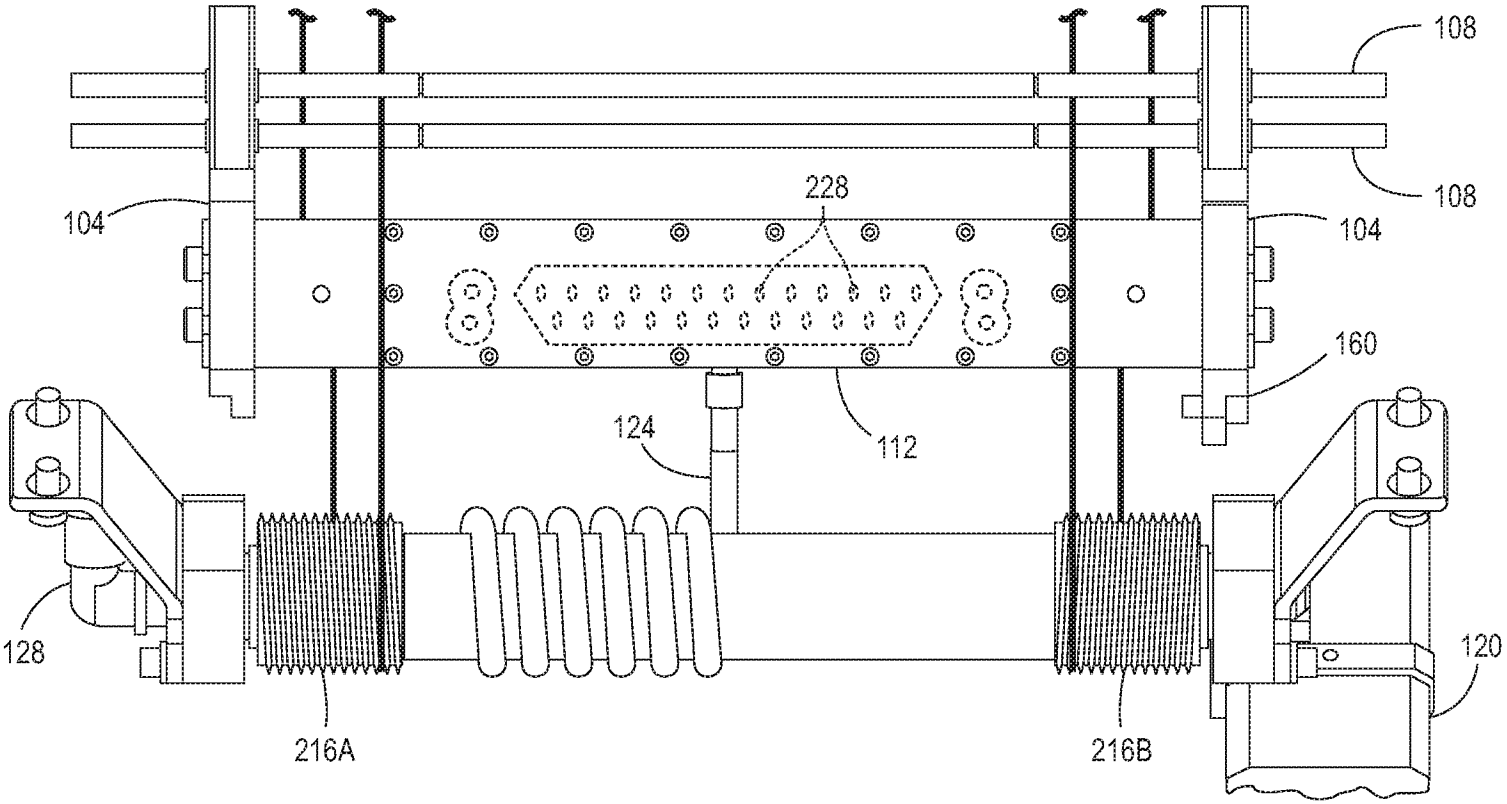
FIG. 3 is a bottom view of the shaft and rinsing member shown in FIG. 2.

With reference to FIG. 3, the length of the cord 220 continues to the tensioning member 148 at the distal cross-members 108 before returning between the cross-members 108 proximate the rinsing member 112 at the first position and then to the second end 220B. Likewise, the length of the cord 224 continues to the tensioning member 148 at the distal cross-members 108 before returning between the cross-members 108 proximate the rinsing member 112 at the first position and then to the second end 224B. The view shown in FIG. 3 is from beneath the rinsing member 112 to reveal an array of openings 228 in the rinsing member 112. The openings 228 permit the fluid flowing from the fluid source 132 through the passageway 208 and tube 124 to exit the rinsing member 112.

Figure 4A:
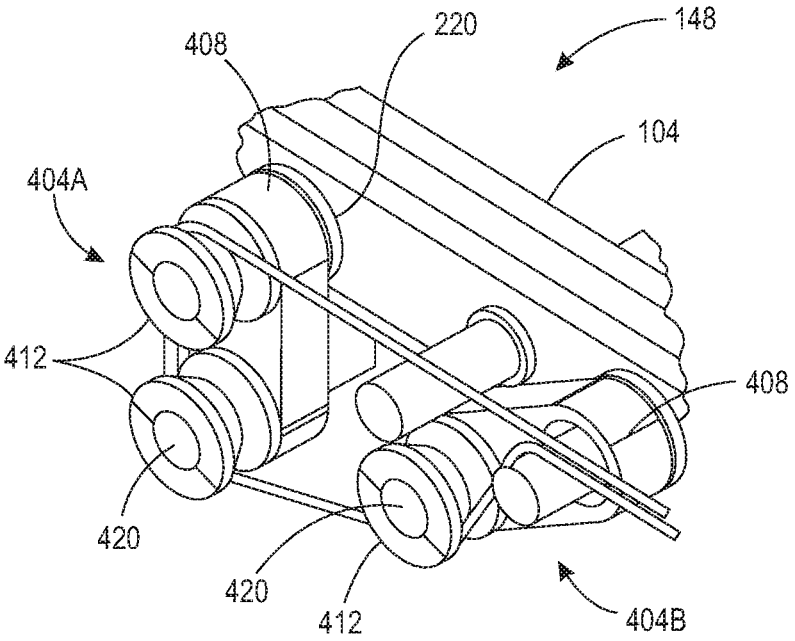
FIG. 4A is a prospective view of one tensioning mechanism in the system of FIG. 1.
Figure 4B:
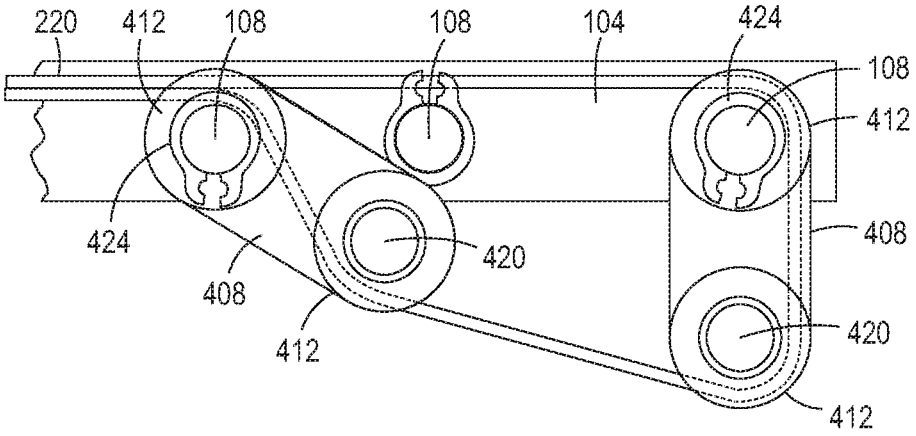
FIG. 4B is a side perspective view of the tensioning mechanism shown in FIG. 4A.
Figure 4C:
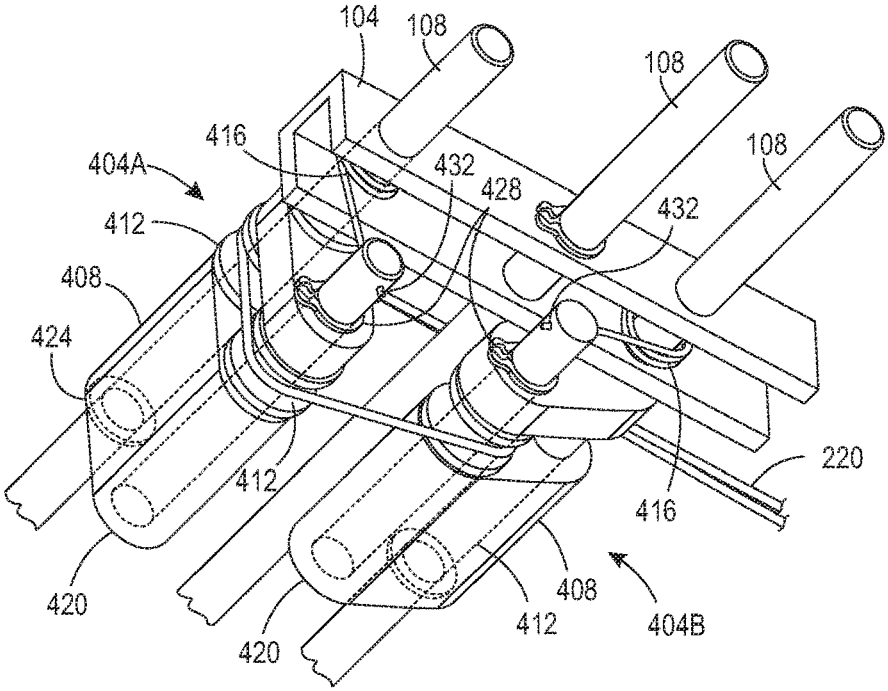
FIG. 4C is a perspective view of the tensioning mechanism shown in FIG. 4A from beneath the mechanism.
Figure 4D:
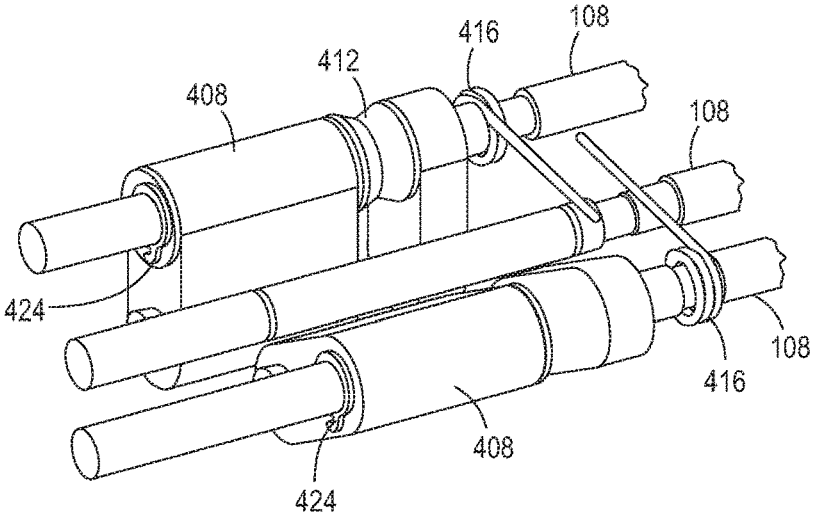
FIG. 4D is a side perspective view of the tensioning mechanism shown in FIG. 4A from above the mechanism.

FIGS. 4A, 4B, 4C, and 4D depict one of the tensioning mechanisms 148. The tensioning mechanism 148 includes two sub-assemblies 404A and 404B. Each sub-assembly includes a mechanical link 408, each having two pulleys 412, a torsion spring 416 (FIG. 4C), and a shaft 420. The mechanical links 408 are mounted around two of the cross-members 108 so a third cross-member is between the links. The links 408 are secured to the cross-members 108 by snap-rings 424, which fit grooves in the cross-members 108 located at a predetermined distance from the guide rail 104. The links are also secured to the shafts 420 by snap rings 428 positioned in grooves on the shafts between the links and the guide rail 104. The tension springs 416 are mounted around the cross-members 108 within the guide rail 104 and one end of each tension spring 416 is inserted in an opening 432 in the shaft 420. The other end of each tension spring 416 rests on the middle cross-member 108 as shown in FIG. 4D. The cord 220 extends from the ribbed nut 216 to one of the pulleys 412 in one of the links 408. From there, the cord continues around the other pulley of the link and then extends past the middle cross-member 108 to one of the pulleys in the other link 408. The cord then continues to the other pulley 412 on the other link 408 and follows along the cord 220 to the rinsing bar 112 and then back to the ribbed nut 216 (FIG. 1).

Each mechanical link 408 works around two axes, one of which is fixed and is defined by the cross member around which the link is mounted and the other one rotates around the cross member and is defined by the shaft 420. The pulleys 412 guide the cord 220 and ensure reduced friction when the cord is moving because shaft 116 is rotating. The cord 220 is routed around the pulleys 412 to ensure tension stability as the length of the path of the cord varies when the rinsing bar 112 leaves its position near the actuator 120 and moves along the guide rails 104. As the cord path length decreases, torsion springs 416 move the rotating shaft 420 downwards to compensate for the cord path length variation and to maintain tension in the cord. As the cord path length increases, torsion springs 416 are compressed and the rotating shaft 420 moves upwards to compensate for the cord path length variation and to limit the tension increase in the cord. The tensioning mechanisms 148 also enable nominal tension of the cords 220 and 224 to be adjusted.

Figure 5:
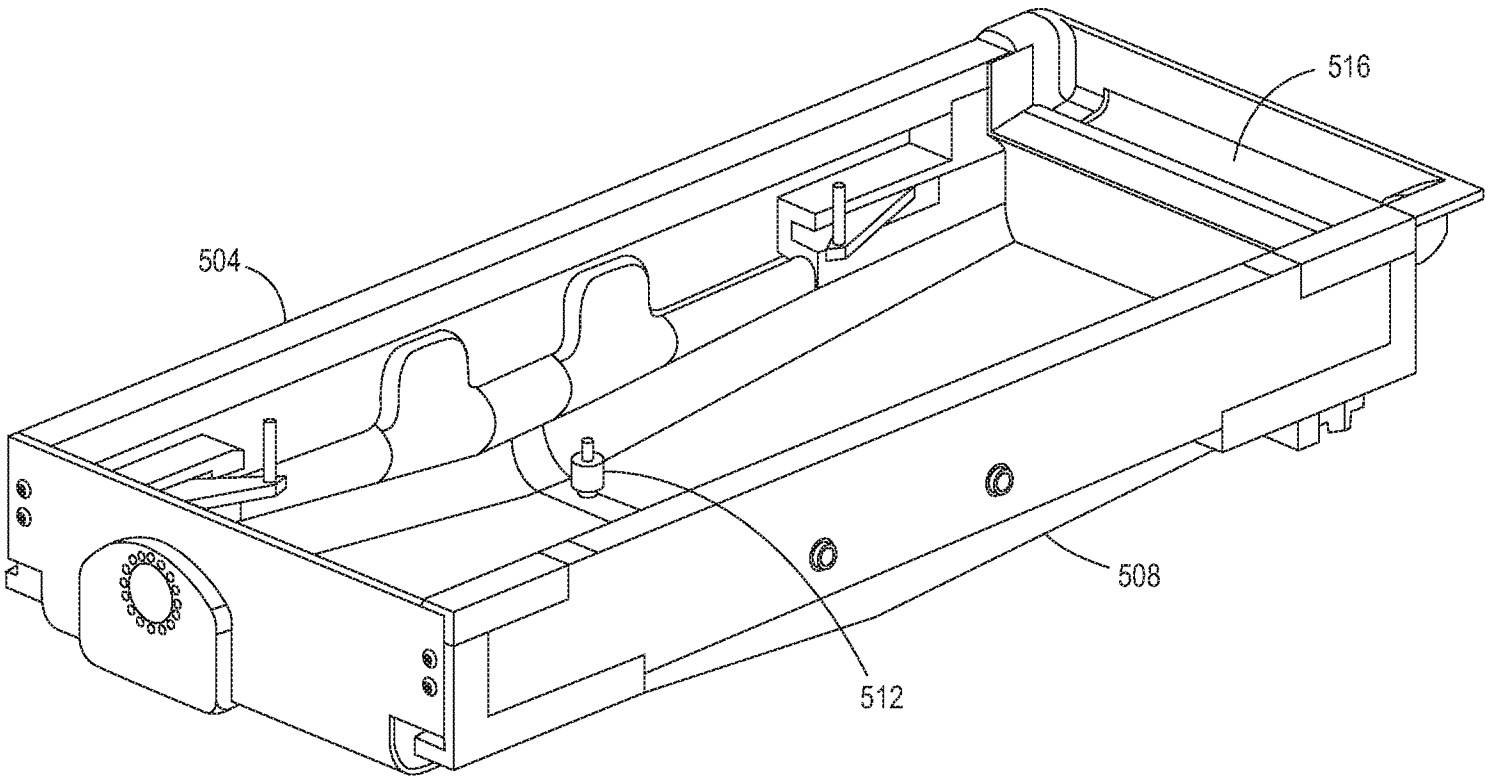
FIG. 5 is a perspective view of a receptacle that is positioned to collect fluid from the system shown in FIG. 1.

FIG. 5 depicts a receptacle 504 to which the cleaning system 100 mounts. The receptacle 504 is integrally made of a thermoplastic material to provide a volume beneath the cleaning system 100 and the components of the printhead cleaning system, although the receptacle could be made of metal, a polymer material, or molded plastic. When the cleaning system is used, the printhead cleaning system is positioned between the cords 220 and 224 and the receptacle 504 so the rinsing bar 112 can eject cleaning fluid on the components of the printhead cleaning system. The cleaning system 100 is positioned with reference to the receptacle 504 so the cords 220 and 224 pass through the slot 516 so the rinsing bar 112 can move with the rotating cords while ejecting cleaning fluid onto the components of the printhead cleaning system. The rotating shaft 116 and the actuator 120 of the cleaning system 100 are positioned outside of the volume within the receptacle 504. As the cleaning system is operated to flush the printhead cleaning system components with cleaning fluid from the fluid source 132, the fluid falls from the components of the printhead cleaning system into the receptacle 504. Receptacle 504 includes an opening 508 in the floor of the receptacle 504 that enables the used cleaning fluid to flow out of the receptacle. The used cleaning fluid can removed passively by gravity or by another pump operatively connected to the opening 508. Positioned closely to the opening 508 is a fluid level sensor 512. The fluid level sensor 512 is configured to generate a signal indicative of a failure of the opening in the receptacle 504 to drain the cleaning fluid from the receptacle volume.

The controller 140 is connected to the sensor 512 to receive this signal and the controller is configured to generate a signal indicating the opening 508 is clogged in response to the signal indicating the drainage failure.

In operation, the printhead cleaning system is moved from time to time so the rinsing bar 112 of the cleaning system 100 can pass over the printhead cleaning system. Once in place, the controller 140 operates the actuator 120 to rotate in the counterclockwise direction to unwind the portion of the cords 220 and 224 wrapped in the clockwise direction around the ribbed nuts 216 at the ends of the shaft 116. As this unwinding of the cords occurs, the other ends of the cords 220 and 224 receive a portion of the cords and wrap them around the other portion of the ribbed nuts on the ends of the shaft at the second ends of the cords. The tensioning mechanisms 148 keep the cords taut as this unwinding and winding of the cords occurs and the wheels 156 of the rinsing member 112 roll along the pair of guide rails 104. The controller 140 also operates the pump 136 to move cleaning fluid from the fluid source 132 into the passageway 208 of the shaft 116 and tube 124 to enter the rinsing member 112. The pressure of the flowing cleaning fluid enables the openings 228 in the rinsing member to release the cleaning fluid onto the components of the printhead cleaning system and the receptacle begins to receive the fluid as it drips off the components. When the controller 140 receives a signal from the sensor 152 that the rinsing member 112 has reached the distal end of the frame, the controller 140 operates the actuator 120 to reverse the direction of its output shaft rotation. This clockwise rotation unwinds the portion of the cords 220 and 224 wrapped in the counterclockwise direction around the ribbed nuts 216 at the ends of the shaft 116. As this unwinding of the cords occurs, the other ends of the cords 220 and 224 receive a portion of the cords and wrap them around the ribbed nuts 216 on the ends of the shaft 116 at the first ends of the cords. The tensioning mechanisms 148 keep the cords taut as this unwinding and winding of the cords occurs and the wheels 156 of the rinsing member 112 roll along the pair of guide rails 104 to return the rinsing member 112 to the first position. When the controller 140 detects that the signal from the sensor 160 indicates the rinsing member 112 has reached its first position, it deactivates the actuator 120 and the pump 136. The printhead cleaning system can be returned to a position where it can be used to clean the faceplates of printheads.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A system for cleaning components used to clean a printhead cleaning system in an inkjet printer comprising:

a pair of parallel members;

at least two cross-members that intersect the pair of parallel members to form a frame;

an actuator configured with a bi-directionally rotating output shaft;

a shaft operatively connected to the rotating output shaft of the actuator to rotate with the output shaft when it rotates, the shaft having a passageway within the shaft, the passageway having a first end and a second end;

a rotating coupling on the shaft that is configured to connect the first end of the passageway pneumatically with a fluid source;

a member having a plurality of openings and the member being pneumatically connected to the fluid source to enable a fluid from the fluid source to flow to the member and egress through the openings, the member being parallel to the at least two cross-members, the member having at least two wheels, one wheel being connected to the member at one end of the member to enable the one wheel to roll along one of the parallel members and the other wheel being connected to the member at an opposite end of the member to enable the other wheel to roll along the other parallel member;

a flexible hollow member having a first end and a second end, the first end of the flexible hollow member being pneumatically connected to the second end of the passageway and the second end of the flexible hollow member being connected to the member, the flexible hollow member being wound around the shaft to enable the flexible hollow member to unwind from the shaft and follow the member as the member moves from the first position to the second position and to be wound around the shaft as the member returns to the first position from the second position;

a first cord and a second cord, the first cord having a first end and a second end and the second cord having a first end and a second end, the first end and the second end of the first cord being wound around the shaft in opposite directions at a first end of the shaft and the first end and the second end of the second cord being wound around the shaft in opposite directions at a second end of the shaft, each cord being operatively connected to the member to enable the actuator to rotate the shaft in a first direction to move the member from a first position at one end of the pair of parallel members to a second position at another end of the pair of parallel members as the fluid egresses through the openings in the member and to rotate the shaft in a direction opposite the first direction to return the member to the first position;

a first tensioning mechanism and a second tensioning mechanism, the first cord being wound through the first tensioning mechanism and the second cord being wound through the second tensioning mechanism, the first tensioning mechanism being positioned at one end of the cross-member positioned at a distance from the shaft that is further than the distance at which the other cross-member is from the shaft and the second tensioning mechanism being positioned at an opposite end of the cross-member positioned at a distance from the shaft that is further than the distance at which the other cross-member is from the shaft, each tensioning mechanism having at least one tension spring and a plurality of pulleys mounted on the cross-member that are positioned at the distance that is further than the distance at which the other cross-member is from the shaft, the at least one tension spring of each tensioning mechanism urging the pulleys away from one another to keep the cord wound through the tensioning mechanism taut;

a receptacle positioned to receive the fluid emitted from the openings in the member after the fluid has cleaned at least one wiper positioned between the receptacle and the pair of parallel members, the receptacle having a floor with an opening in the floor to enable fluid collected in the receptacle to be removed;

a fluid level sensor positioned proximate the opening in the floor of the receptacle, the fluid level sensor being configured to generate a signal indicating a failure of the receptacle to drain the fluid through the opening in the floor of the receptacle;

a pump operatively connected to the fluid source;

a position sensor configured to generate a signal indicative of the member being present or absent at the second position; and a controller operatively connected to the pump, the actuator, the position sensor, and the fluid sensor, the controller being configured to operate the actuator to move the member from the first position to the second position and to return the member to the first position from the second position, to operate the pump to move fluid from the fluid source through the passageway in the shaft to the member and through the openings in the member as the member moves from the first position to the second position and returns to the first position from the second position, to receive from the fluid sensor the signal indicative of the failure of the receptacle to drain the fluid through the opening in the floor of the receptacle, and to receive the signal from the position sensor and to reverse operation of the actuator in response to the signal from the position sensor indicating the member is present at the second position.

2. The cleaning system of claim 1 wherein a portion of the at least one cord goes around the cross-member located at a greater distance from the shaft than the other cross-member.

3. The system of claim 1 further comprising:

another position sensor configured to generate a signal indicative of the member being present or absent at the first position; and the controller being further configured to receive the signal from the other position sensor and to stop operation of the actuator in response to the signal from the other position sensor indicating the member is present at the first position.

* * * * *